US011047331B2

(12) United States Patent
Talaski

(10) Patent No.: US 11,047,331 B2
(45) Date of Patent: Jun. 29, 2021

(54) FUEL SYSTEM WITH VARIABLE OUTPUT FUEL PUMP

(71) Applicant: Walbro LLC, Tucson, AZ (US)

(72) Inventor: Edward J. Talaski, Caro, MI (US)

(73) Assignee: WALBRO LLC, Tucson, AZ (US)

( * ) Notice: Subject to any disclaimer, the term of this patent is extended or adjusted under 35 U.S.C. 154(b) by 0 days.

(21) Appl. No.: 16/978,243

(22) PCT Filed: Mar. 14, 2019

(86) PCT No.: PCT/US2019/022171
§ 371 (c)(1),
(2) Date: Sep. 4, 2020

(87) PCT Pub. No.: WO2019/182843
PCT Pub. Date: Sep. 26, 2019

(65) Prior Publication Data

US 2021/0003091 A1 Jan. 7, 2021

Related U.S. Application Data

(60) Provisional application No. 62/644,656, filed on Mar. 19, 2018.

(51) Int. Cl.
*F02M 37/08* (2006.01)
*F02D 41/30* (2006.01)
(Continued)

(52) U.S. Cl.
CPC ..... *F02D 41/3082* (2013.01); *F02D 33/003* (2013.01); *F02D 2041/226* (2013.01);
(Continued)

(58) Field of Classification Search
CPC ..... F02D 41/3082; F02D 33/003; F02D 2041/226; F02D 2041/2027;
(Continued)

(56) References Cited

U.S. PATENT DOCUMENTS 5,265,644 A 11/1993 Tuckey
5,975,061 A 11/1999 Briggs et al.
(Continued)

FOREIGN PATENT DOCUMENTS

JP 2006523897 A 10/2006
KR 20080029585 A 4/2008
WO WO2013109272 A1 7/2013

OTHER PUBLICATIONS

Written Opinion & International Search Report for PCT/US2019/022171 dated Jun. 27, 2019, 12 pages.

*Primary Examiner* — Hai H Huynh
(74) *Attorney, Agent, or Firm* — Reising Ethington P.C.

(57) ABSTRACT

In at least some implementations, a system includes a pump having an electric motor and a pump outlet, a controller coupled to the pump to vary the power provided to the motor to vary the flow rate of liquid discharged from the pump outlet, a pressure regulator having an inlet communicated with the pump outlet, a regulator outlet from which liquid is discharged from the regulator, a bypass outlet through which liquid is discharged from the regulator, and a pressure responsive valve that opens to permit liquid flow through the bypass outlet, and a flow sensor. The flow sensor is communicated with the bypass outlet to sense or determine a flow rate of liquid at or downstream of the bypass outlet, the flow sensor also communicated with the controller to provide an indication of the bypassed liquid flow rate to the controller.

15 Claims, 2 Drawing Sheets

(51) Int. Cl.
*F02D 33/00* (2006.01)
*F02D 41/22* (2006.01)

(52) U.S. Cl.
CPC .. *F02D 2200/0602* (2013.01); *F02D 2250/31* (2013.01); *F02M 2037/085* (2013.01)

(58) Field of Classification Search
CPC ..... F02D 2200/0602; F02D 2250/31; F02M 2037/085
USPC ..... 123/446, 495, 497, 456, 457, 458, 510, 123/511; 701/103–107
See application file for complete search history.

(56) References Cited

U.S. PATENT DOCUMENTS

| | | | |
|---|---|---|---|
| 6,279,541 | B1 | 8/2001 | Doane et al. |
| 6,962,485 | B2 | 11/2005 | Bennett et al. |
| 2008/0173280 | A1 | 7/2008 | Hou |

FUEL SYSTEM WITH VARIABLE OUTPUT FUEL PUMP

REFERENCE TO RELATED APPLICATIONS

This application claims the benefit of U.S. Provisional Application Ser. No. 62/644,656 filed on Mar. 19, 2018 the entire contents of which is incorporated herein by reference in its entirety.

TECHNICAL FIELD

The present disclosure relates generally to a fuel system that includes fuel pump that output of which may be varied such as by varying the power supplied to the fuel pump.

BACKGROUND

Fuel systems for combustion engines can sometimes include a fuel pump assembly that pumps fuel from a fuel tank to an engine. The assembly may include a fuel pump having an electric motor that drives a pumping element to take fuel into the fuel pump through an inlet, increase the pressure of the fuel, and discharge the fuel from the fuel pump for delivery to the engine. The fuel demand of the engine varies according to the speed of and load on the engine, and so the fuel system needs to accommodate a range of fuel flow rates.

SUMMARY

In at least some implementations, a liquid pumping system includes a pump having an electric motor and a pump outlet through which liquid is discharged under pressure, a controller coupled to the pump to vary the power provided to the motor to vary the flow rate of liquid discharged from the pump outlet, a pressure regulator having an inlet communicated with the pump outlet, a regulator outlet from which liquid is discharged from the regulator, a bypass outlet through which liquid is discharged from the regulator, and a pressure responsive valve that opens when the pressure of liquid acting on the valve is greater than a threshold pressure to permit liquid flow through the bypass outlet, and a flow sensor. The flow sensor is communicated with the bypass outlet to sense or determine a flow rate of liquid at or downstream of the bypass outlet, the flow sensor also communicated with the controller to provide an indication of the bypassed liquid flow rate to the controller.

In at least some implementations, a second controller is communicated with the controller coupled to the pump, and the second controller provides an indication of the liquid demand in the system to the controller coupled to the pump. The electric motor may include brushes and have a minimum current level below which increased wear of the brushes will occur, and the controller may vary power to the pump as a function of the bypassed liquid flow rate and as a function of the minimum current level. In at least some implementations the controller varies the power to the pump as a function of the bypassed liquid flow rate.

In at least some implementations, the flow sensor is a switch that has one state when there is no flow at the switch and another state when there is flow at the switch. The one state of the switch may be open and the another state of the switch may be closed. In at least some implementations, the flow sensor is a pressure switch that detects the presence or absence of a liquid pressure at the switch, or changes in pressure in a flow of liquid communicated with the switch.

In at least some implementations, a method of operating an electric motor liquid pump that provides an output flow of liquid to a pressure regulator having a bypass outlet through which liquid is diverted in at least some operating conditions, includes determining if the rate or amount of flow through the bypass outlet is above or below a threshold flow, and varying electric power provided to the motor of the pump in response to the flow through the bypass outlet. In at least some implementations, the at least one threshold flow rate is zero.

In at least some implementations, the method also includes the step of storing in memory the amount by which the power provided to the pump is varied, and using the stored amount as a calibration or correction value to alter the pump power duty cycle for future operation of the pump.

In at least some implementations, the method includes the steps of determining a demanded liquid flow rate, and providing power to the pump at a level to cause the pump to supply liquid at a flow rate that exceeds the demanded liquid flow rate and thereby cause liquid flow through the bypass outlet. In at least some implementations, the demanded liquid flow rate is determined by at least one sensor that is responsive to one or more of throttle position, engine speed, engine load, and/or one or more properties of an exhaust gas emitted from the engine.

In at least some implementations, a method of operating a liquid pump with an electric, includes determining or accessing from memory a minimum current level for the electric motor of the pump, determining a demanded liquid flow rate, determining if the demanded liquid flow rate corresponds to a current level that is less than the minimum current level, and providing current to the electric motor of the pump at a level greater than is necessary to cause the pump to meet the demanded liquid flow rate if the demanded liquid flow rate corresponds to a current level that is less than the minimum current level. In at least some implementations, the minimum current level is chosen to reduce wear of brushes in the pump. In at least some implementations, when the electric motor of the pump is provided with a current greater than necessary to cause the pump to meet the demanded liquid flow rate, the method further comprises bypassing a portion of the liquid discharged from the pump.

BRIEF DESCRIPTION OF THE DRAWINGS

The following detailed description of certain embodiments and best mode will be set forth with reference to the accompanying drawings, in which.

DETAILED DESCRIPTION

Figure 1:
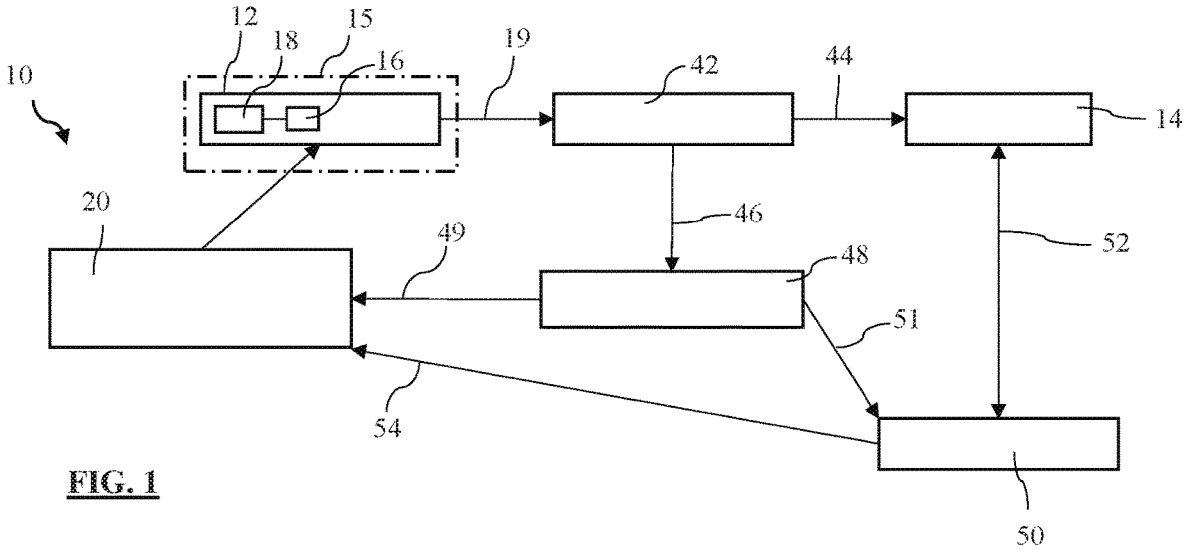
FIG. 1 is a block diagram of a fuel system including a fuel pump.

Referring in more detail to the drawings, FIG. 1 illustrates a fuel system 10 including a fuel pump 12 that provides pressurized fuel to an internal combustion engine 14. The fuel pump 12 may be received within a fuel tank 15, may have an inlet into which fuel from the fuel tank 15 is drawn by a pumping element 16, like an impeller or gears, that is driven by an electric motor 18. The fuel taken into the pumping element 16 is then pressurized and discharged from an outlet 19 of the fuel pump 12 for delivery to the engine 14. In at least some implementations, the motor 18 is supplied with electrical power from a battery, alternator or both. The fuel pump 12 may provide fuel at a desired pressure for the fuel system 10 in which the fuel pump is used, and be capable of providing a maximum output fuel flow rate suitable to meet the maximum fuel demand of the engine 14.

Figure 4:
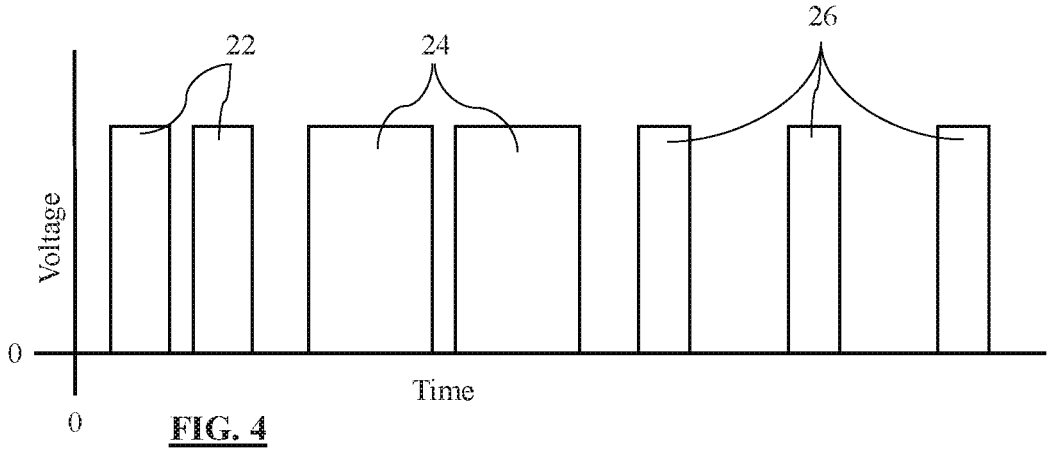
FIG. 4 is a graph of voltage vs. time showing representative duty cycles for the fuel pump.

The output fuel flow rate from the fuel pump 12 may be varied by controlling the power supplied to the fuel pump motor 18. In one form, a controller 20 provides a pulse width modulated (PWM) power supply to the fuel pump 12. The PWM power supply varies the duty cycle of the power signal to vary the speed of the pump motor 18 and thus, the output from the pump 12. The duty cycle may be represented by a square wave signal that varies between high and low. In FIG. 4, the representative signal is shown with voltage on the y-axis and time on the x-axis. When the signal is high or "on", power is supplied to the fuel pump and when the signal is low or "off", power is not supplied to the fuel pump. Accordingly, a signal that is on 50% of the time corresponds to a 50% duty cycle, and a signal that is on 100% of the time corresponds to a 100% duty cycle and maximum fuel pump speed and output (e.g. volumetric flow rate). In FIG. 4, the first two waveforms (labeled 22) show an approximate 50% duty cycle and the next two (labeled 24) show an approximate 90% duty cycle, and the final three waveforms (labeled 26) show an approximate 25% duty cycle. Of course, other duty cycles may be used, these waveforms are merely representative.

By changing the duty cycle of the power signal provided to the fuel pump motor 18, the output of the fuel pump 12 can be changed. Hence, when fuel demand is known, the fuel pump output can be changed to a desired output that corresponds to the engine fuel demand. The fuel pump 12 may be controlled to eliminate pumping more fuel than the engine needs, or to reduce the amount of fuel pumped in excess of engine demand.

In brushed motor fuel pumps, wherein the motor 18 includes conductive brushes engaged with a commutator, the brushes may wear out more rapidly when the current provided to the brushes is lower than an optimized current. Accordingly, optimizing the current supplied through the brushes can reduce wear on the brushes and extend the life of the motor 18. In circumstances in which the engine fuel demand is low, such as at engine idle or other low speed and low load engine operation, the fuel pump 12 can be operated at a relatively low duty cycle and still supply all fuel demanded by the engine 14. However, the low duty cycle may result in a lower than optimum current to the motor brushes, which may cause non-optimal wear on the brushes compared to when the motor 18 is operated at a higher current. At least some fuel pumps 12 have less than optimal brush wear when operated continually or intermittently at lower currents associated with pulse width modulated control systems, wherein lower current is supplied to the fuel pump motor 18 when lower fuel pump output is desired.

Figure 2:
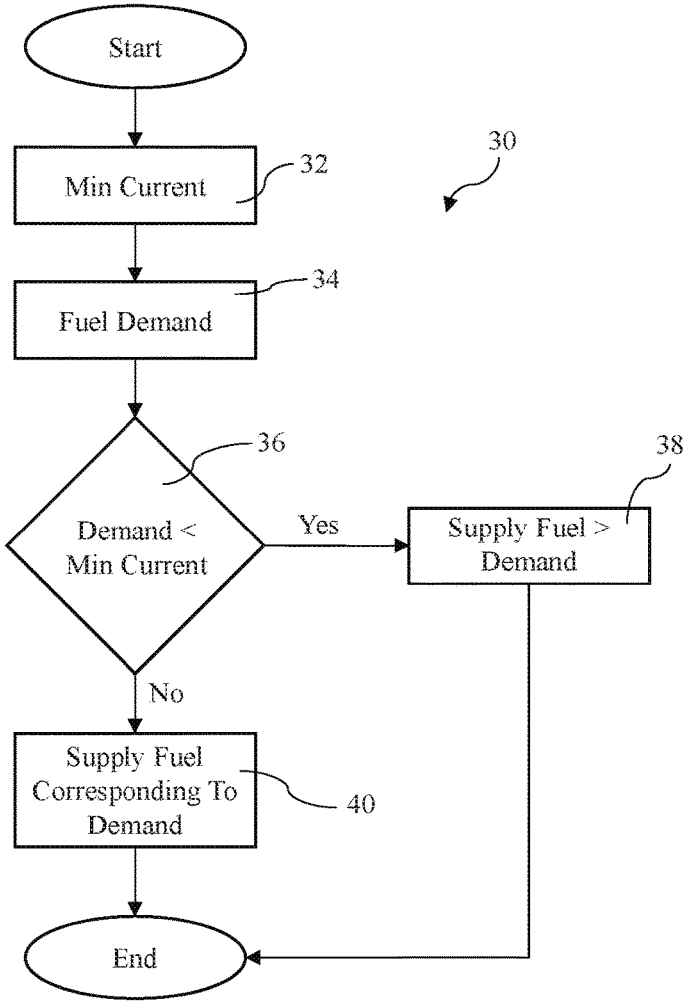
FIG. 2 is flow chart of a method of operating the fuel pump.

Accordingly, to improve the in-service or useful life of the brushes or for other reasons, in at least some implementations, the fuel pump motor 18 may be supplied with power beyond what is needed to cause the fuel pump 12 to meet the engine fuel demand. A control plan or strategy 30, such as is shown in FIG. 2, may be implemented as a function of a threshold current for the brushes, wherein the threshold current may be a minimum current at which the pump 12 should be operated to provide a desired useful life of the brushes. The threshold current at which the fuel pump 12 should be operated is determined in step 32 (and is noted in FIG. 2 as the minimum current, although any threshold may be used). Then, when the engine fuel demand, which is determined in step 34, corresponds to a duty cycle that would result in a current to the brushes that is below the threshold current, as determined in step 36, the duty cycle actually provided to the motor in step 38 is greater than what corresponds to the engine fuel demand, and is sufficient to provide at least the threshold current through the brushes. This avoids the situation in which an undesirably low (e.g. below the threshold) current is provided to the pump motor 18. When the engine fuel demand corresponds to a duty cycle that would result in a current to the brushes that is at or above the threshold current, the duty cycle actually provided to the fuel pump in step 40 may be at or greater than the duty cycle needed to meet the engine fuel demand.

When the duty cycle provided to the motor is greater than required to meet the engine fuel demand, the output from the fuel pump may be greater than what will be consumed by the engine. To accommodate the excess fuel discharged from the fuel pump, at least some implementations of a fuel system include a fuel flow controller 42 that permits fuel flow to the engine 14 at a rate and pressure to meet the engine fuel demand, but bypasses or does not deliver to the engine 14 fuel in excess of the engine fuel demand. In at least some implementations, the fuel flow controller is a bypass fuel pressure regulator 42 that has an inlet in communication with the fuel pump output 19, a primary output 44 through which fuel is directed toward the engine 14 (e.g. through fuel lines to a fuel rail or intake manifold) and a bypass outlet 46 through which fuel is discharged and returned to the fuel tank, either directly in a so-called no-return fuel system (when the fuel pump 12 and/or bypass regulator 42 are received within the fuel tank) or through a fuel line in a return-type fuel system (e.g. when the fuel pump and/or bypass regulator are outside of the fuel tank, such as at a fuel rail, and fuel is bypassed and returned to the fuel tank via a conduit).

When the pressure of fuel across the flow controller 42 is greater than a threshold pressure, fuel is bypassed through the bypass outlet 46 and is not delivered to the engine. Among other things, this may facilitate maintaining a desired system pressure and meet the engine fuel demand. In at least some implementations, to ensure the engine fuel demand is always met, the fuel pump 12 may be always operated to provide at least some bypass fuel flow. That is, the fuel pump 12 provides some fuel beyond the instantaneous engine fuel demand to ensure that the engine 14 is not starved of fuel, and to facilitate support of engine acceleration (i.e. increasing engine fuel demand), among other possible reasons for doing so.

In at least one implementation, to detect the presence and/or magnitude of bypass fuel flow from the pressure regulator 42, a sensor 48 is provided that is responsive to the flow or flow rate of fuel bypassed by the regulator 42. The flow sensor 48 may be coupled with one or more controllers, including the fuel pump controller 20 (as diagrammatically shown by line 49 in FIG. 1) that manages the power supply to the fuel pump 12, and an engine controller 50 (as diagrammatically shown by line 51) that manages at least some aspects of engine operation (e.g. injection and/or ignition timing and the like, via wired or wireless communication indicated at 52 in FIG. 1). The controller 50 may determine or participate in determining the engine fuel demand and whether the fuel demand is being met, and may do so as a function of one or more sensors responsive to, for example, throttle position, engine speed and/or load, and/or exhaust gas sensors (which may, for example, indicate whether the fuel and air mixture provided to the engine is too lean, or too rich). The controller 50 may communicate with the controller 20 such as via one or more wires or wirelessly, as generically shown by line 54 in FIG. 1.

Figure 3:
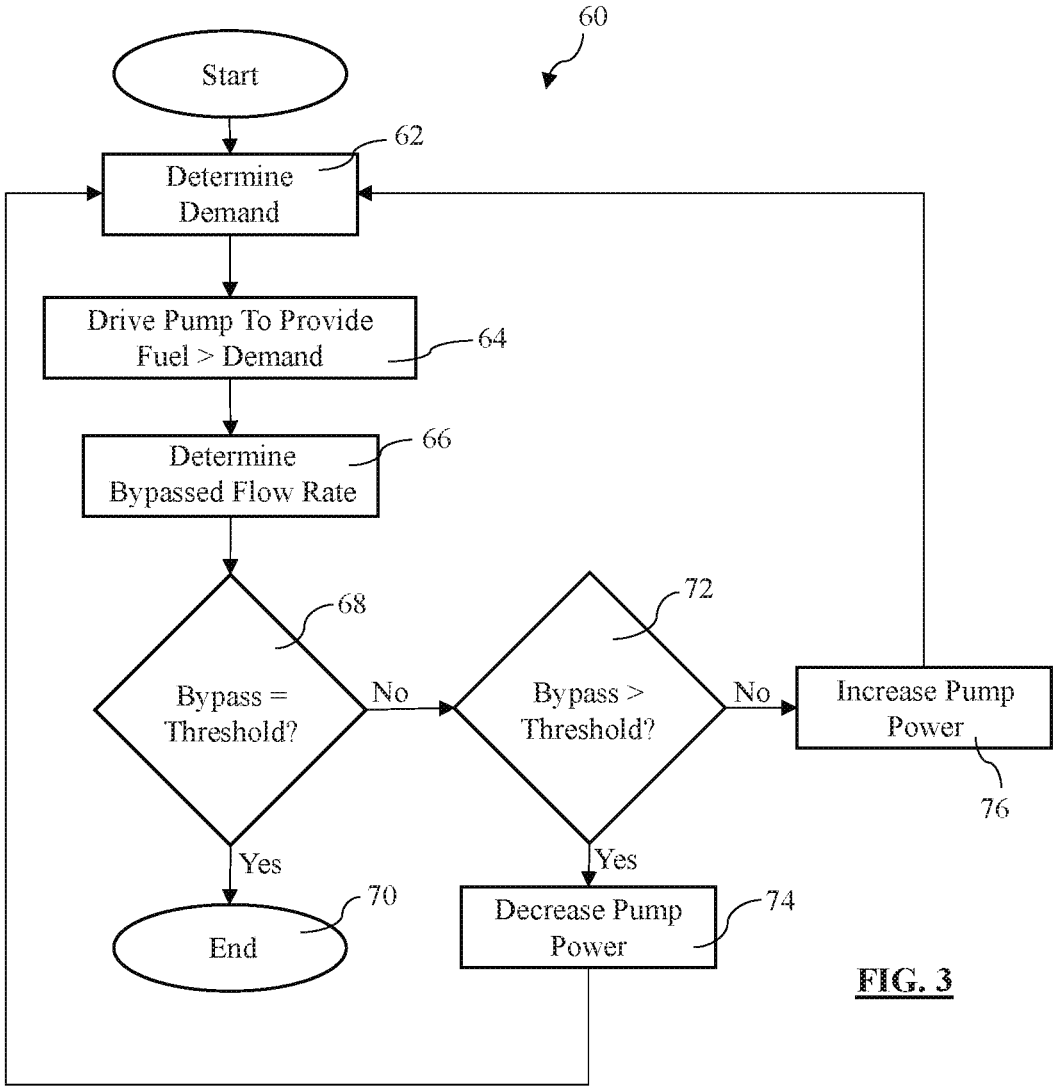
FIG. 3 is a flow chart of a method of operating the fuel pump.

In the method 60 of FIG. 3, an engine demand can be determined at 62, and the pump can be driven with a duty cycle or otherwise to exceed the engine fuel demand at 64. The bypass flow rate as determined by the flow sensor 48 can be determined at 66, and then at 68 the bypass flow rate can be compared to an expected output or threshold flow rate based upon an expected fuel pump performance at the power level (e.g. duty cycle) provided to the fuel pump 12, which corresponds to an expected or threshold bypass fuel flow rate. If the bypass flow rate is equal to the threshold, where the threshold may include an acceptable range of flow rates, then the pump is operating as expected and the process may end at 70. If the output from the flow sensor 48 indicates that the fuel pump 12 is actually providing fuel at a higher flow rate than expected, as determined at 72 which would be indicated by a higher flow rate of bypassed fuel than expected for a given engine operating condition and a given fuel pump power duty cycle, then the power provided to the fuel pump 12 may be decreased at 74 (e.g. reduced power duty cycle) to avoid wasting energy and pumping more fuel than needed. The method may then return to the beginning (e.g. step 62) to check the bypass flow rate at the lower power duty cycle. If the output from the flow sensor 48 indicates that the fuel pump 12 is actually providing fuel at a lower flow rate than expected, which would be indicated by a lower flow rate of bypassed fuel than expected for a given engine operating condition and a given fuel pump power duty cycle, this may indicate that the brushes are becoming worn or the fuel pump 12 is not operating as expected for other reasons (e.g. clogged filter, etc). In response, the fuel pump power duty cycle may be increased at 76 to increase fuel pump output (and hence, bypassed fuel flow rate) to an expected level. The amount by which the fuel pump power duty cycle is increased may be stored and, in effect, become a calibration or correction value used to alter the fuel pump power duty cycle for future operation, at least until such time that the fuel pump output is above the expected rate whereupon the duty cycle may be decreased by a desired amount. And the method may then return to the beginning (e.g. step 62) to check the bypass flow rate at the higher power duty cycle.

Hence, deteriorating pump performance can be overcome by feedback control of the operating parameters of the fuel pump 12, for example, the power duty cycle. Further, the system 10 can avoid providing a lower than desired duty to the fuel pump to avoid non-optimal brush wear in the first instance, to reduce the likelihood of reduced pump performance and/or extend the life of the fuel pump. While shown as being associated with bypass fuel flow from the pressure regulator 42, the fuel sensor 48 could be located within the flow path between the fuel pump outlet and the engine 14. That is, in the path of fuel actually delivered to the engine 14. Further, with a more consistent fuel supply (e.g. more consistent fuel pressure) to the engine 14, hydrocarbon emissions may be reduced. The more consistent fuel supply may be achieved with use of a regulator 42 and thus, a more accurate power control scheme to precisely control fuel pump output to closely match engine fuel demand is not needed. The control based upon bypass flow rate is at least somewhat independent of the fuel supply to the engine 14, with the bypass regulator 42 between the engine 14 and bypass flow sensor 48.

Further, the flow sensor 48 may be less expensive than a fuel pressure sensor to provide further economy without sacrificing the ability to control the fuel pump as noted herein. Additionally, fuel pressure sensors can have faults or otherwise come out of calibration and not function as desired, which may interfere with the fuel system 10 properly meeting fuel demand. Still further, without any pressure regulator, quickly reduced fuel demand (e.g. rapid change from wide open throttle to idle) can result in an overpressure condition in the system due to providing fuel to meet the higher demand which no longer exists. Thus, systems typically require a pressure release valve and thus, extra cost and complexity in the fuel system. In at least one implementation, the flow sensor 48 is a switch that has one state (e.g. open) where there is no bypass flow and another state (e.g. closed) when there is bypass flow. In this way, the system 10 can determine if there is bypass flow or not, but not necessarily the magnitude or flow rate of the bypass fuel flow. Different flow sensors may be used to provide a relative, general or precise indication of the bypass fuel flow rate, as desired for a particular application. Thus, the system can be flexible in implementation and provided at different cost levels. Of course, the fuel system 10 could include a pressure sensor to determine engine fuel demand or for other reasons, as desired. The flow sensor and bypass regulator are not necessarily exclusive of pressure sensors in all systems. In at least some implementations, the flow sensor may be a pressure switch which detects the presence or absence of a liquid pressure at the switch, or changes in pressure in a flow of liquid communicated with the switch. Such a pressure switch may measure or detect pressure upstream of a valve or orifice, such as upstream of the regulator or the bypass outlet of the regulator.

In at least some implementations, the fuel pump output pressure may be between 200 and 500 kPa, the fuel pump output flow rate may be up to 300 liters per hour, the fuel pressure regulator set point may be between 200-500 kPa, the pump supply voltage may be between 6-15 volts, a minimum desired current to the fuel pump may be 50% of the nominal current value for the pump, a preferred minimum voltage delivered to the pump is higher than 60% and may be about 75% (plus or minus 10%) of the nominal voltage, the fuel pressure regulator may bypass up to 300 liters per hour, and the fuel pump may be operated at a duty cycle of between 50 and 100%.

Further, the methods and modes of operating noted herein may also be applied to a brushless pump, for example, to permit control of the power supplied to the brushless electric motor of such pumps in response to a bypass flow from a bypass regulator as noted herein. That is, the systems and methods are not limited to pumps with electric motors that include brushed commutators, nor to systems and methods arranged to inhibit or prevent non-optimal brush wear. Instead, the systems and methods may be used to control the power supplied to and the output flow rate from an electric motor pump with or without brushes.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A liquid pumping system, comprising:

a pump including an electric motor, and a pump outlet through which liquid is discharged under pressure;

a controller coupled to the pump to vary the power provided to the motor to vary the flow rate of liquid discharged from the pump outlet;

a pressure regulator having an inlet communicated with the pump outlet, a regulator outlet from which liquid is discharged from the regulator, a bypass outlet through which liquid is discharged from the regulator, and a pressure responsive valve that opens when the pressure of liquid acting on the valve is greater than a threshold pressure to permit liquid flow through the bypass outlet; and a flow sensor communicated with the bypass outlet to sense or determine a flow rate of liquid at or downstream of the bypass outlet, the flow sensor also communicated with the controller to provide an indication of the bypassed liquid flow rate to the controller.

2. The system of claim 1 which also includes a second controller that is communicated with the controller coupled to the pump, the second controller providing an indication of the liquid demand in the system to the controller coupled to the pump.

3. The system of claim 1 wherein the electric motor includes brushes and has a minimum current level below which increased wear of the brushes will occur, and wherein the controller varies power to the pump as a function of the bypassed liquid flow rate and as a function of the minimum current level.

4. The system of claim 1 wherein the controller varies the power to the pump as a function of the bypassed liquid flow rate.

5. The system of claim 1 wherein the flow sensor is a switch that has one state when there is no flow at the switch and another state when there is flow at the switch.

6. The system of claim 5 wherein the one state of the switch is open and the another state of the switch is closed.

7. The system of claim 1 wherein the flow sensor is a pressure switch that detects the presence or absence of a liquid pressure at the switch, or changes in pressure in a flow of liquid communicated with the switch.

8. A method of operating an electric motor liquid pump that provides an output flow of liquid to a pressure regulator having a bypass outlet through which liquid is diverted in at least some operating conditions, comprising:

determining if the rate or amount of flow through the bypass outlet is above or below a threshold flow; and varying electric power provided to the motor of the pump in response to the flow through the bypass outlet.

9. The method of claim 8 wherein said at least one threshold flow rate is zero.

10. The method of claim 8 which also comprises the step of storing in memory the amount by which the power provided to the pump is varied, and using the stored amount as a calibration or correction value to alter the pump power duty cycle for future operation of the pump.

11. The method of claim 8 which also includes the steps of:

determining a demanded liquid flow rate;

providing power to the pump at a level to cause the pump to supply liquid at a flow rate that exceeds the demanded liquid flow rate and thereby cause liquid flow through the bypass outlet.

12. The method of claim 11 wherein the demanded liquid flow rate is determined by at least one sensor that is responsive to one or more of throttle position, engine speed, engine load, and/or one or more properties of an exhaust gas emitted from the engine.

13. A method of operating a liquid pump with an electric, comprising:

determining or accessing from memory a minimum current level for the electric motor of the pump;

determining a demanded liquid flow rate;

determining if the demanded liquid flow rate corresponds to a current level that is less than the minimum current level; and providing current to the electric motor of the pump at a level greater than is necessary to cause the pump to meet the demanded liquid flow rate if the demanded liquid flow rate corresponds to a current level that is less than the minimum current level.

14. The method of claim 13 wherein the minimum current level is chosen to reduce wear of brushes in the pump.

15. The method of claim 13 wherein when the electric motor of the pump is provided with a current greater than necessary to cause the pump to meet the demanded liquid flow rate, the method further comprises bypassing a portion of the liquid discharged from the pump.

* * * * *